US007070174B2

(12) United States Patent
Hultholm et al.

(10) Patent No.: US 7,070,174 B2
(45) Date of Patent: Jul. 4, 2006

(54) MIXING APPARATUS FOR MIXING GAS IN A CLOSED REACTOR

(75) Inventors: Stig-Erik Hultholm, Pori (FI); Mikko Juusela, Pori (FI); Launo Lilja, Liisankatu (FI); Bror Nyman, Vanha-Ulvila (FI)

(73) Assignee: Outokumpu Technology Oy, Espoo (FI)

( * ) Notice: Subject to any disclaimer, the term of this patent is extended or adjusted under 35 U.S.C. 154(b) by 84 days.

(21) Appl. No.: 10/332,436

(22) PCT Filed: Jul. 19, 2001

(86) PCT No.: PCT/FO01/00678

§ 371 (c)(1),
(2), (4) Date: Sep. 29, 2003

(87) PCT Pub. No.: WO02/07866

PCT Pub. Date: Jan. 31, 2002

(65) Prior Publication Data

US 2004/0062144 A1 Apr. 1, 2004

(30) Foreign Application Priority Data

Jul. 21, 2000 (FI) ..... 20001698

(51) Int. Cl.
*B01F 7/26* (2006.01)

(52) U.S. Cl. ..... 261/84; 366/307; 366/317; 422/228

(58) Field of Classification Search ..... 261/84; 422/225, 228; 366/307, 317, 329.1, 330.1, 366/330.5; 435/303.3
See application file for complete search history.

(56) References Cited

U.S. PATENT DOCUMENTS

| | | | | |
|---|---|---|---|---|
| 727,032 | A * | 5/1903 | Tubbs | 261/32 |
| 3,179,380 | A * | 4/1965 | Drayer | 366/178.3 |
| 3,462,131 | A * | 8/1969 | Hill | 366/176.1 |
| 3,606,577 | A * | 9/1971 | Conn | 416/181 |
| 4,438,074 | A * | 3/1984 | Wilt | 422/135 |
| 4,548,765 | A | 10/1985 | Hultholm et al. | 261/93 |
| 4,951,262 | A | 8/1990 | Phillippi et al. | 366/279 |
| 5,078,505 | A * | 1/1992 | Nyman et al. | 366/262 |
| 5,240,327 | A * | 8/1993 | Nyman et al. | 366/302 |
| 2003/0227817 | A1 * | 12/2003 | Martel et al. | 366/142 |

FOREIGN PATENT DOCUMENTS

| | | |
|---|---|---|
| SE | 456725 B | 10/1988 |
| WO | 97/25133 | 7/1997 |

* cited by examiner

*Primary Examiner*—David Sorkin
(74) *Attorney, Agent, or Firm*—Morgan&Finnegan, LLP

(57) ABSTRACT

The invention relates to a mixing apparatus and a method for mixing gas in a closed mixing reactor, which uses gas as a process chemical with a high efficiency and where the content of pulverous solids in the solution is great. The aim is to obtain a flow in the reactor which sucks gas from above the surface of the liquid using rotating mixing devices in the centre of the reactor, and to mix said gas throughout the reactor capacity. The mixing apparatus of the invention comprises at least two mixers located at different heights, and on the same shaft. The upper mixer is equipped with a central plate attached to the shaft, with essentially vertical inner blades rising upwards and downwards and outer vanes directed outwards from the central plate, which are inclined from the horizontal. The lower mixer is equipped with a central plate attached to the shaft with vertical blades located on the outer edge.

7 Claims, 4 Drawing Sheets

MIXING APPARATUS FOR MIXING GAS IN A CLOSED REACTOR

Figures 1, 2, 3:
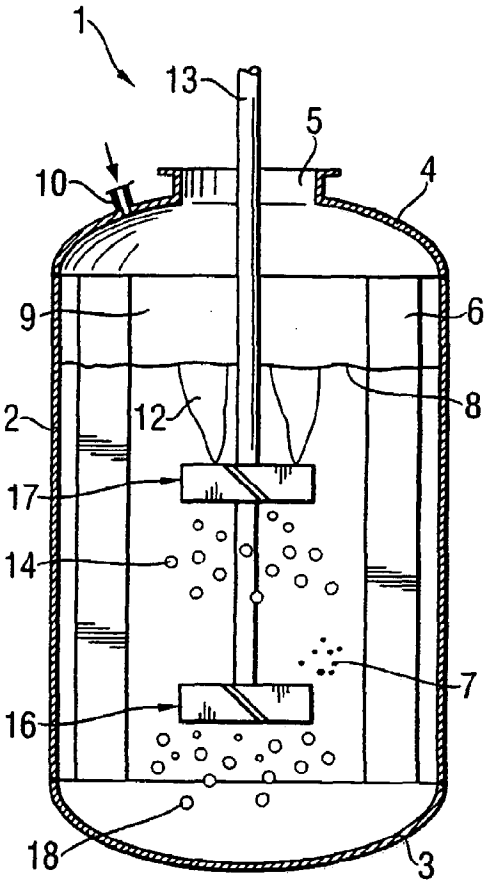
Fig. 1 PRIOR ART
Fig. 2 PRIOR ART
Fig. 3 PRIOR ART

The present invention relates to a mixing apparatus and a method for mixing gas in a closed mixing reactor, particularly in an autoclave, which uses gas as a process chemical with a high efficiency and where the content of pulverous solids in the solution is great. The aim is to obtain a flow in the reactor which sucks gas from above the surface of the liquid using rotating mixing devices in the centre of the reactor, and to mix said gas throughout the reactor capacity. The mixing apparatus of the invention comprises at least two mixers located at different heights, and on the same shaft. The upper mixer is equipped with a central plate attached to the shaft, with essentially vertical inner blades rising upwards and downwards and outer vanes directed outwards from the central plate, which are inclined from the horizontal. The lower mixer is equipped with a central plate attached to the shaft with vertical blades located on the outer edge.

Autoclaves are normally horizontal, often with several compartments and without flow baffles. Gas feed usually takes place by feeding air, oxygen (oxidation) or hydrogen (reduction) into the effective range of a powerful dispersing mixing device. Often in closed reactors such as autoclaves it is desirable to return the gas from above the surface back into the solution. When air is used this is not sensible, as in that case the amount of nitrogen only builds up in a layer, but with both pure oxygen and hydrogen even residual gas can be used again by sucking it from above the surface.

For sucking gas from above the surface and then dispersing it, pipes known as self-suction crosspipes exist, where the gas space at the bottom end of the hollow shaft branches out usually into four pipes open at their top end. The rotating crosspipe creates a vacuum in the gas space, which causes the gas to discharge and be dispersed into bubbles in the solution space of the reactor. It is to be noted that as the temperature of the solution rises, so does the steam pressure in which case the effect of the vacuum decreases. This kind of crosspipe construction cannot, however, disperse the gas further into the solution, much less keep a (thick) solid suspension moving.

It is also known before to suck gas from the surface, with the down-draft principle. U.S. Pat. No. 4,454,077 describes an apparatus where a mixing device resembling a two-headed screw is used to pump the gas down through a central pipe, and in addition the apparatus includes upper and lower flow baffles. U.S. Pat. No. 4,328,175 describes a similar type of apparatus, but the upper end of the central pipe is conical in shape.

It is thus known that gas is driven into the mixer due to the powerful central vortex at the shaft of the mixer, i.e. the intensified suction of the gas into the solution. This powerful and often extensive gas vortex conveys the gas from the surface into the liquid or solution to be mixed sometimes even too effectively, but at a certain gas rate the operation of the mixing device declines, as the mixer rotates "in a large gas bubble". Then, as the power weakens so does the vortex, and the suction of gas from the surface into the solution decreases. The vortex created in the manner described above is, however, uncontrolled and, when extending as far as the gas mixing device, it causes strong power changes and consequent damage to the equipment. What is worse, the mixer is no longer able to achieve the mixing of the pulverous solids due to its ineffectiveness particularly with thick suspension densities of pulverous solids.

A method for sucking gas from above a liquid surface is known from U.S. Pat. No. 5,549,854 using a rotating mixing device as the energy source and adjustable special flow baffles. Controlled suction vortexes can be achieved with this method, which do not immediately convey the gas to the mixing device itself.

Getting a sufficient amount of gas into a solid-solution suspension in closed oxidation or reduction reactors, particularly in cases of high solids content (>50%), normally requires that the gas enters the solution space of the lower part of the reactor, mainly under the mixing device. Often this gas is routed down through the surface of solution past the mixer and its lower end through a pipe directed towards the central axel of the reactor and turned under the mixer. This is how it is attempted to get the gas into the lower section and dispersed using the mixer.

In autoclaves in particular the reactor has to be lined with some special substance, mostly with titanium. The same goes for gas feed pipes for instance. The treatment of titanium, welding etc., is more difficult than normal. In addition, titanium is more expensive than ordinary materials. These factors set considerable demands on mixing and gas dispersion. The mixer attains powerful flows, because the slurry contains a large amount of solids, and when these flows hit against the gas pipes, in the worst cases they can wear them through. This means that the gas rises upwards without even touching the mixing device for dispersing it and thus the efficiency of gas worsens considerably.

The autoclave is also known for the fact that enlarging the size of the apertures made in it leads to an increase in wall thickness, which translates directly into money. For this reason, the apertures made in the reactor cover for the mixing device are usually of the order of ø 600–800 mm. One very important matter in the maintenance/replacement of mixers is that this work is able to be done by lifting the mixer straight up from the aperture i.e. usually the size of the mixer is determined by the extent of the aperture in the autoclave. If the process requires a lot of shaft power ($kW/m^3$), it is worth using a mixer which requires/gives a lot of power. The power given by the mixer can of course be increased by raising the rotational speed, but it must be remembered that, at the same time, the tip speed of the mixer will increase. When it increases noticeably (>6 m/s), significant wear of the mixer will also start to take place.

The present invention relates to a mixing apparatus and a method for mixing gas in a closed reactor, particularly in an autoclave, which uses gas as a process chemical with a high efficiency and where the content of pulverous solids in the solution is great. The aim is to obtain a flow in the reactor, which sucks gas from above the surface of the liquid using rotating mixing devices in the centre of the reactor. The mixing apparatus of the invention comprises at least two mixers located at different heights, and on the same shaft. The upper mixer is equipped with a central plate attached to the shaft, with substantially vertical inner blades rising upwards and downwards from the central plate and outer vanes directed outwards, which vanes are inclined from the horizontal. The lower mixer is equipped with a central plate attached to the shaft with vertical vanes located on the outer edge of the central plate. The essential features of the invention will be made apparent in the attached patent claims.

The method now developed according to the invention for achieving a controlled central vortex near the shaft in a closed reactor such as an autoclave, occurs using at least two mixing devices with separate function installed one on top of the other on the same shaft. The arrangement is such that it enables the elimination of the drawbacks of the prior methods and nevertheless achieves an effective gas vortex that sucks gas into the liquid, primarily by means of the uppermost mixing device. This device is used both to form the gas vortex in question as well as to disperse the sucked-in gas into small bubbles and to press the small gas bubbles thus distributed evenly in the solids suspension down to the lower mixing device in the extensive flow surrounding the shaft. The lowermost mixer possesses significantly greater energy than the upper mixing device. With this energy the gas bubbles pulled down are dispersed ever smaller, thus increasing the gas and liquid contact surface, whereupon the reactions take place much more quickly and completely than in ordinary methods. The residual energy is used to mix and spread the solid particles in large slurry contents throughout the whole volume of the reactor.

Both mixers and especially the lower one are therefore developed so that they can take more shaft power than normal. In most reactors of the prior art the gas in the slurry is only partially dispersed in a large volume and therefore reduces the shaft power of the mixer.

Stated briefly the idea of the invention is as follows: the uppermost mixing device is such that it causes suction of the gas above the surface of the solids-solution suspension forming several funnel-like gas vortexes in the solution above the mixer. These gas pockets are further sucked in by the mixer itself and are dispersed into small bubbles by the central, almost upright mixer blades. The bubbles formed from this move sideways away from the central shaft towards other i.e. outer vanes, which are at a suitable angle from the horizontal, preferably 45°. The bubbles mixed into the solution spread further out due to these vanes, but however they are pushed downwards at the same time to the lowest mixing device.

The lowest mixing device takes significantly more shaft power than the upper one, whereby it is possible to disperse the bubbles coming there extremely finely without losing much mixing energy. In addition to spreading the finely dispersed bubbles to the side and then upwards with the flow field, the lower mixer has enough power to elutriate pulverous solids into an even suspension throughout the solution space. Thus the entire method according to this invention guarantees sufficient suction of gas from the liquid surface, two-stage and effective dispersion, considerable mixing energy and an even solids suspension throughout the whole of the reactor despite high suspension density.

Figure 5A:
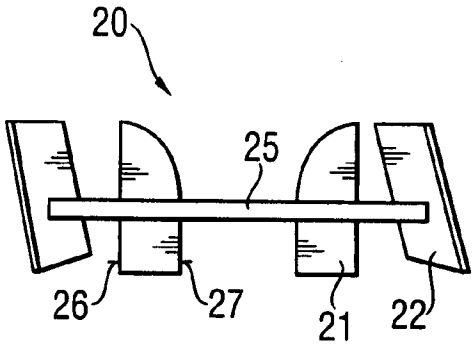
Figure 5B:
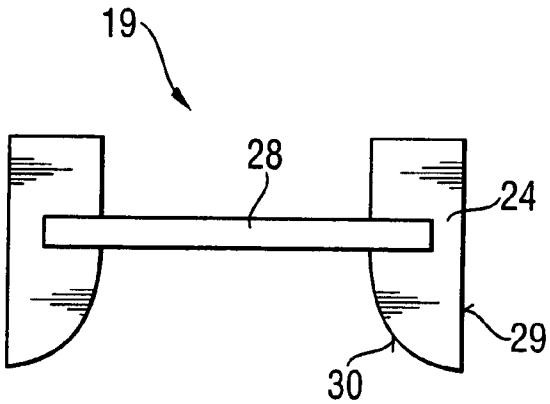
Figure 4:
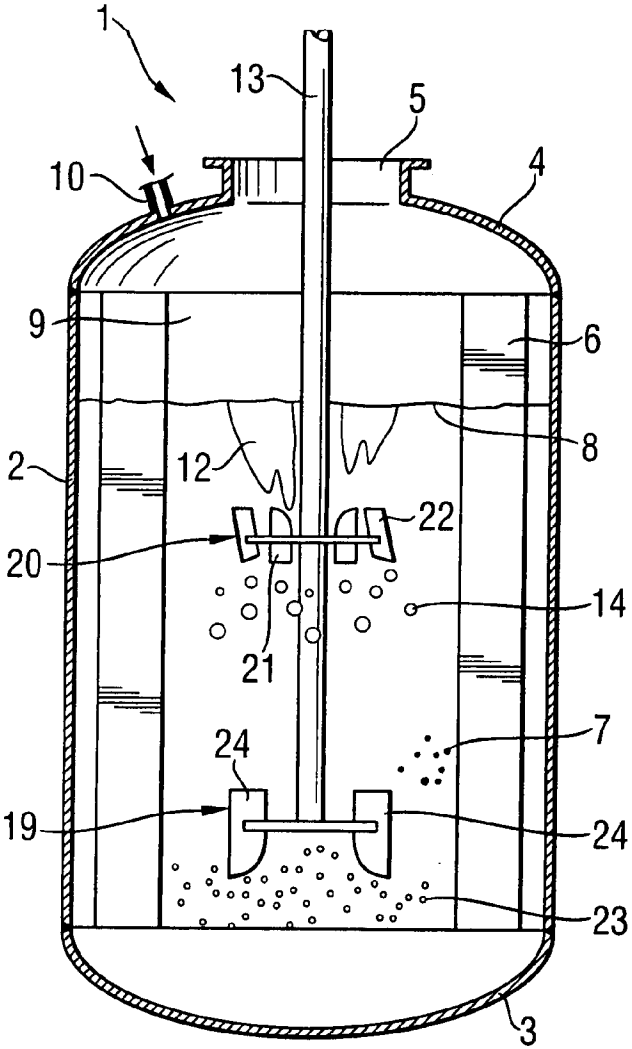
Figure 6:
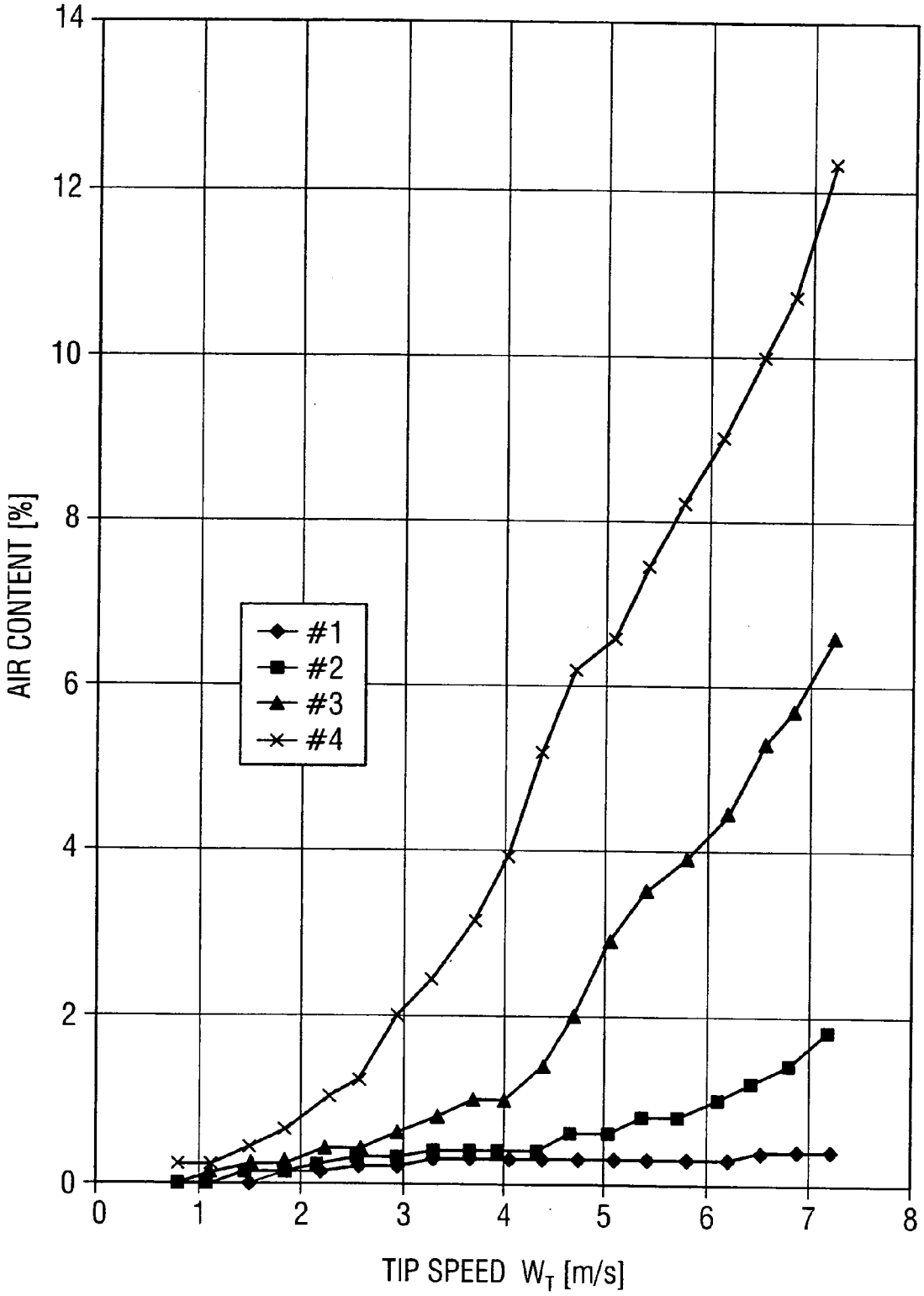
Figure 7:
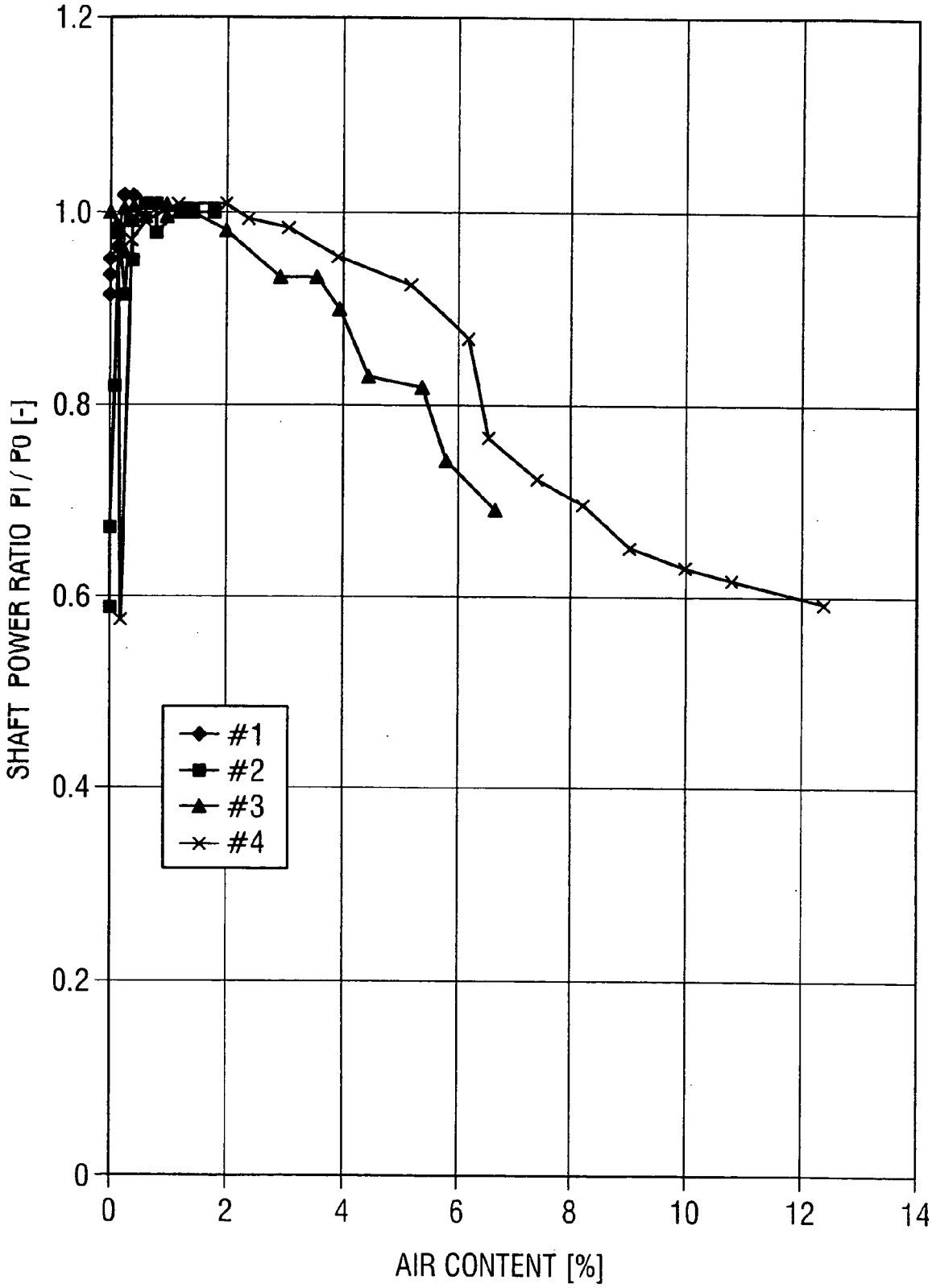

The apparatus accordant with the invention is described here in more detail with reference to the attached drawings, where FIG. 1 shows a vertical section of a simpliest form of an embodiment of the prior art, where the chief attention is paid to mixing the solids and where the suction of gas from the surface is not very effective, FIG. 2 illustrates a vertical section of another simple form of an embodiment of the prior art, where attention is paid to the suction of gas from the surface, but which fails in mixing the solids, FIG. 3 illustrates a vertical section of a more advanced form of an embodiment of the prior art, where attention is paid to both mixing of solids and suction of gas from the surface, FIG. 4 shows a vertical section of an application of the invention, where attention is paid particularly to both mixing of solids and suction of gas from the surface, FIG. 5A illustrates a vertical section of an upper mixer according to the invention, where chief attention is paid to the suction of gas from the liquid surface and to the achievement of the required dispersion energy as well as mixing the bubbles generated into the solution and pushing them down, FIG. 5B shows a vertical section of a lower mixer according to the invention, where attention is paid to both mixing the solids and achieving the mixing energy required for sucking the gas from the surface, FIG. 6 is a graphic display of the air content of the gas as a function of the tip speed of the various mixers, and FIG. 7 is a graphic display of the shaft power ratio of the various mixers as a function of air content.

FIG. 1 shows a closed upright reactor 1 comprising a cylindrical section 2, closed lower section 3 and cover section 4. There is an aperture 5 in the cover section, which is usually the same size as the diameter of the mixer. Obviously the aperture is closed during operation. The great gas swirl, or vortex, created by the mixing in the reactor is impeded mainly by four standard baffles 6. The reactor is filled with a solution containing solid particles 7. Above the surface 8 of the solution is a gas space 9, which is filled via a gas feed pipe 10 and from where the mixer 11 obtains conical gas formations 12 on the solution surface. An ordinary four-blade mixer is fixed to the bottom end of the shaft 13, where the blade angle is adjustable separately. Generally the angle is 45°.

FIG. 2 shows a reactor like the one in FIG. 1. The difference is that the mixer 11 has been raised nearer to the solution surface 8. The conical gas formations 12 achieved by the mixer 11 are dispersed into bubbles 14 by the mixer and pushed some way downwards, not, however, right to the bottom, because the flow directed to the mixer shaft is not so strong that the suspension of solids 15 would take place properly. The mixer is the same kind as that in FIG. 1.

FIG. 3 shows a reactor like the one in FIG. 1. The difference is that there are two mixers; the lower one 16 near the bottom and the upper one 17 on the same shaft is near the solution surface 8. The conical gas formations 12 achieved by the mixer 11 are dispersed into bubbles 14 by the mixer and pushed some way downwards to the mixer 16. The task of the lower mixer should be to disperse the gas bubbles further into even smaller bubbles 18 and to spread the bubbles into the solution as well as causing a flow to the bottom which would even make a suspension of the solids in the solution. Both mixers are blade mixers as described in FIG. 1.

FIG. 4 shows that the reactor 1 is a closed reactor such as an autoclave, like the previous figures. The difference compared with FIG. 3 is that the lower mixer 16 is replaced with a lower mixer 19 according to this invention, and that the upper mixer 17 is replaced with an upper mixer according to this invention 20. The upper mixer 20 is presented in more detail in FIG. 5A and the lower mixer 19 in FIG. 5B. The many small conical gas formations 12 achieved on the solution surface 8 by the upper mixer 20 are dispersed by the upright inner blades 21 shaped according to the invention into far smaller bubbles 14 than in the case of FIG. 3.

The outer vanes 22 of the upper mixer 20 spread out and push down the bubbles formed there to the lower mixer 19. This receives and further disperses the gas bubbles into extremely small bubbles 23 with the vertical blades 24 shaped according to the invention. The same powerful flow-giving blades spread these small bubbles into the surrounding solution and simultaneously suspend the solid particles 7.

The mixer combination of the invention works ideally because, despite their smallish size (within the limits allowed by the aperture 5) both mixers produce considerably more mixing energy than normal for gas dispersion and solid suspension and lose power very slowly as the amount of gas increases, which is due entirely to efficient dispersing and the way of spreading the bubbles.

If required, they may be several mixers, but the uppermost mixer is then as in the description of the upper mixer and the lowest mixer is as in the description of the lower mixer. An intermediate mixer may be selected as needed from for example the mixers according to the invention.

FIG. 5A shows the upper mixer 20 of the invention in more detail, where preferably six specially shaped vertical inner blades 21 are fitted on a circular central plate 25. The central plate is attached symmetrically to mixer shaft 13, as shown in FIG. 4. The inner blades 21 are attached radially to the inner part of the central plate 25 and extend above and below the central plate. The blades are attached to the central plate at more or less their midpoint (as seen in elevation). The outer edge 26 of each inner blade is vertical and the inner edge 27 below the central plate is also vertical. The inner edge of the blade above the central plate narrows towards the outer edge, shaped like a circular arc. The purpose of the vertical blades is to disperse the gas and transfer the bubbles that are formed towards the outer vanes 22.

The outer vanes 22 of the upper mixer 20 are basically rectangular and are attached to the outer edge of the central plate 25 and they are inclined from the horizontal. The number of outer vanes is the same as that of the vertical vanes and they are fixed to the central plate in a corresponding position to the vertical blade. The angle of inclination of the outer vanes is 30–60°, preferably 45°, from the horizontal. The purpose of these outer vanes is to cause a downward flow to the lower mixer and to distribute the bubbles outwards and downwards.

The mixer in FIG. 5B is a lower mixer 19 according to the invention, where preferably six specially shaped vertical blades 24 are attached to the round plate 28. These vertical blades are otherwise the same shape as the inner blades 21 of the upper mixer 20 shown in FIG. 5A, but upside down. The blades are attached radially to the outer edge of the central plate 28 so that they extend above and below the plate. The blades are attached to the central plate at more or less their midpoint (as seen in elevation). The outer edge 29 of each blade is basically vertical as is the upper part of the inner edge 30, but the lower part of the inner edge narrows towards the outer edge, shaped like a circular arc.

The invention is illustrated in more detail by the following examples.

EXAMPLE 1

The ability to suck gas (air) from the surface was studied for all four cases (the reactors and mixers shown in FIGS. 1, 2, 3 and 4) by measuring the rise in the solution surface (water) i.e. the air content (%). The diameters of the mixers were almost equal, i.e. the ratio of the mixer diameter to the reactor diameter was 0.39. FIG. 6 presents the test results as a function of the mixer tip speed. The results put the effectiveness of gas suction of the different mixer arrangements in clear order i.e. the order from worst to best is: FIG. 1, FIG. 2, FIG. 3 and FIG. 4.

EXAMPLE 2

The ability to withstand the gas (air) sucked from the surface of the same four cases (the reactors and mixers shown in FIGS. 1, 2, 3 and 4) was investigated by measuring their shaft power Pi (kW). This was compared with an power Po for a normal gas-free solution. FIG. 7 presents the results as a function of the amount of air (air content) sucked in by the mixer. The results show that in the cases of FIGS. 1 and 2 the amount of air sucked in was non-existent or so small that it could not even be compared with the cases of FIGS. 3 and 4. The results again put the mixers in a clear order of durability of effectiveness, i.e. the order from worst to best is: FIG. 1, FIG. 2, FIG. 3 and FIG. 4.

EXAMPLE 3

Tests were made for the same four cases (the reactors and mixers shown in FIGS. 1, 2, 3 and 4) on their ability to suspend heavy pulverous solids at the same time as gas (air) is being sucked from the surface. The test was performed by measuring the tip speed required and the corresponding shaft power/solution volume (kW/m$^3$), when all the powder is moving well at the bottom of the reactor. The test results are presented in the table below:

| Case (FIG.) | Tip speed m/S | Shaft power/volume kW/m$^3$ |
|---|---|---|
| 1 | =4.8 | =5.6 |
| 2 | >7.1 | >4.7 |
| 3 | =4.7 | =2.6 |
| 4 | =2.8 | =2.0 |

The table shows that, when using one mixer: when the mixer is low (FIG. 1) mixing of the solids can be achieved using quite a lot of shaft power, but air is not sucked from the surface. When the mixer is high (FIG. 2), air is sucked to some extent, but the solids are not set in motion. Using two mixers: embodiments of the prior art (FIG. 3) do suck air from the surface and the solids are set in motion, but with the method of the invention (FIG. 4) twice as much air is sucked in and the solids move more effectively. This is intensified when more solids are added.

The invention claimed is:

1. A mixing apparatus for the suction of gas from above the surface of a liquid and for mixing it in a closed, vertical reactor equipped with baffles, said mixing apparatus comprising at least two mixers located at different heights on a mixer shaft, an upper mixer being equipped with a central plate attached to the mixer shaft, with essentially vertical inner blades rising upwards and downwards from the central plate and outer vanes directed outwards from the central plate, which are inclined from the horizontal, wherein inner edges of the vertical inner blades of the upper mixer above the central plate narrow outwards, and a lower mixer being equipped with a central plate attached to the mixer shaft with vertical blades located on the outer edge of said central plate.

2. The mixing apparatus according to claim 1, wherein the inner blades of the upper mixer are fixed radially to the inner part of the circular central plate.

3. The mixing apparatus according to claim 1, wherein the outer edge of the inner blades of the upper mixer and the inner edge below the central plate are vertical.

4. The mixing apparatus according to claim 1, wherein the outer vanes of the upper mixer are inclined at an angle of 30–60° from the horizontal.

5. The mixing apparatus according to claim 1, wherein the vertical blades of the lower mixer are attached radially to the outer edge of the central plate extending above and below the plate.

6. The mixing apparatus according to claim 1, wherein the outer edge of the vertical blades of the lower mixer and the upper part of the inner edge are substantially vertical.

7. The mixing apparatus according to claim 1, wherein the inner edges of the vertical blades of the lower mixer below the central plate narrow outwards.

* * * * *